US008192229B2

(12) United States Patent
Endo

(10) Patent No.: US 8,192,229 B2
(45) Date of Patent: Jun. 5, 2012

(54) L-SHAPED CONNECTOR HOUSING AND TERMINAL

(75) Inventor: Tatsuya Endo, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/561,034

(22) Filed: Sep. 16, 2009

(65) Prior Publication Data

US 2010/0068930 A1 Mar. 18, 2010

(30) Foreign Application Priority Data

Sep. 17, 2008 (JP) ..... 2008-238510

(51) Int. Cl.
*H01R 13/40* (2006.01)

(52) U.S. Cl. ..... 439/596

(58) Field of Classification Search ..... 439/596, 439/467, 423, 694, 689, 582, 881, 409, 752, 439/466

See application file for complete search history.

(56) References Cited

U.S. PATENT DOCUMENTS

| | | | | |
|---|---|---|---|---|
| 2,745,938 | A * | 5/1956 | Brandler | 219/256 |
| 2,968,786 | A * | 1/1961 | Wootton | 439/752 |
| 3,075,167 | A * | 1/1963 | Kinkaid | 439/636 |
| 3,206,715 | A * | 9/1965 | Skony | 439/685 |
| 3,312,931 | A * | 4/1967 | Keller | 439/855 |
| 3,519,978 | A * | 7/1970 | Taormina et al. | 439/596 |
| 3,842,396 | A * | 10/1974 | Olsson | 439/685 |
| 3,964,815 | A * | 6/1976 | McDonough | 439/423 |
| 4,109,992 | A * | 8/1978 | Hughes et al. | 439/620.21 |
| 4,264,118 | A * | 4/1981 | Nijman | 439/400 |
| 5,024,610 | A * | 6/1991 | French et al. | 439/857 |
| 5,252,094 | A * | 10/1993 | Colleran et al. | 439/733.1 |
| 5,288,242 | A * | 2/1994 | Muzslay | 439/349 |
| 5,310,362 | A * | 5/1994 | Bauerle et al. | 439/620.21 |
| 5,427,544 | A * | 6/1995 | Okabe | 439/397 |
| 5,466,174 | A * | 11/1995 | Savage, Jr. | 439/596 |
| 5,564,952 | A * | 10/1996 | Davis | 439/682 |
| 5,830,006 | A * | 11/1998 | Koumatsu et al. | 439/449 |
| 6,030,722 | A * | 2/2000 | Kuboshima et al. | 429/178 |
| 6,062,909 | A * | 5/2000 | Zeller et al. | 439/620.21 |
| 6,074,238 | A * | 6/2000 | DeRoss et al. | 439/409 |
| 6,109,975 | A * | 8/2000 | Nitta | 439/686 |
| 6,224,428 | B1 * | 5/2001 | Chen et al. | 439/694 |
| 6,250,952 | B1 * | 6/2001 | Shiga et al. | 439/466 |
| 6,254,436 | B1 * | 7/2001 | Nitta et al. | 439/689 |
| 6,276,960 | B1 * | 8/2001 | Schaefer et al. | 439/522 |
| 6,325,661 | B1 * | 12/2001 | Tabata | 439/459 |
| 6,383,038 | B2 * | 5/2002 | Murakami et al. | 439/854 |

(Continued)

FOREIGN PATENT DOCUMENTS

| | | |
|---|---|---|
| JP | 2000-30796 | 1/2000 |

(Continued)

*Primary Examiner* — Neil Abrams
(74) *Attorney, Agent, or Firm* — Finnegan, Henderson, Farabow, Garrett & Dunner, L.L.P.

(57) ABSTRACT

A connector comprising: a connector housing including an upper wall, a bottom wall, and a side wall which define an opening having an U-shape when viewed from in a direction parallel to each of the upper wall, the bottom wall, and the side wall, wherein the opening opens in the direction; a terminal accommodated in the connector housing and including an end to which a wire is fastened, the end contacting both the upper wall and the bottom wall at the opening; and a cover which covers and uncovers the opening. The cover may be pivotally mounted to the connector housing.

10 Claims, 13 Drawing Sheets

U.S. PATENT DOCUMENTS

| | | | | |
|---|---|---|---|---|
| 6,439,914 | B2 * | 8/2002 | Nimura | 439/352 |
| 6,443,765 | B2 * | 9/2002 | Ichio et al. | 439/587 |
| 6,467,942 | B2 * | 10/2002 | Alloway et al. | 362/549 |
| 6,482,035 | B2 * | 11/2002 | Okabe et al. | 439/596 |
| 6,666,708 | B2 * | 12/2003 | Saito | 439/466 |
| 6,837,733 | B2 * | 1/2005 | Katsuma | 439/352 |
| 6,837,745 | B2 * | 1/2005 | Takada et al. | 439/595 |
| 6,910,904 | B2 * | 6/2005 | Herrick et al. | 439/271 |
| 6,926,535 | B2 * | 8/2005 | Tsuji | 439/31 |
| 6,962,504 | B2 * | 11/2005 | Fukui et al. | 439/466 |
| 7,029,335 | B2 * | 4/2006 | Osada | 439/694 |
| 7,059,918 | B2 * | 6/2006 | Matsumoto et al. | 439/752 |
| 7,097,489 | B2 * | 8/2006 | Yen et al. | 439/336 |
| 7,147,503 | B2 * | 12/2006 | Shindo | 439/354 |
| 7,204,711 | B2 * | 4/2007 | Garcia et al. | 439/336 |
| 7,530,861 | B2 * | 5/2009 | Nakamura | 439/854 |
| 7,549,868 | B1 * | 6/2009 | Ho | 439/63 |
| 2002/0049004 | A1 * | 4/2002 | Davis et al. | 439/685 |

FOREIGN PATENT DOCUMENTS

| | | |
|---|---|---|
| JP | 2006-318801 | 11/2006 |

* cited by examiner

Background Material

Background Material

L-SHAPED CONNECTOR HOUSING AND TERMINAL

CROSS-REFERENCE TO RELATED APPLICATIONS

This patent application claims priority form Japanese Patent Application JP 2008-238510 filed on Sep. 17, 2009, and the subject matters of which are incorporated herein.

TECHNICAL FIELD

This invention relates a connector in which an opening of a connector housing for the insertion of a terminal therethrough can be covered or closed by a cover.

BRIEF DESCRIPTION OF THE RELATED ART

FIGS. 17 and 18 show one related connector of the type described (see, for example, JP-A-2000-30796 (FIGS. 2 and 4)).

As shown in FIGS. 17 and 18, this connector 1 includes a synthetic resin-made connector housing 2 having a terminal receiving chamber 2*a* for receiving terminals (not shown) therein and also having an opening 2*b* for the insertion of the terminals therethrough, and a cover 7 for opening and closing the opening 2*b* through a pair of hinge portions 6 and 6 formed integrally on a lower portion of an edge portion 2*c* of the opening 2*b*.

Through holes 2*d* are formed through a front wall of the connector housing 2, and mating terminals (not shown) are passed respectively through the through holes 2*d*. Through holes 7*a* are formed through the cover 7, and the terminals as well as wires connected respectively to these terminals, are passed respectively through the through holes 7*a*.

When the hinge portions 6 are flexibly bent so as to close the opening 2*b* of the connector housing 2 with the cover 7, a pair of engagement arms 8 and 8 formed respectively at opposite side portions of the cover 7 are guided respectively by two pairs of upper and lower guide projections 3 formed respectively at opposite side surfaces of the connector housing 2, and then are retained respectively by a pair of lock projections 4 and 4 formed respectively at central portions of the opposite side surfaces of the connector housing 2, and at this time an arm-like lock piece portion 9 formed on a central portion of an upper surface of the cover 7 is retained by a bridge-like lock reception piece portion 5 formed on a central portion of an upper surface of the connector housing 2.

Also see JP-A-2006-318801 (FIGS. 4 and 5) as an example for a related connector.

In the above related connector 1, when the opening 2*b* of the connector housing 2 is closed by the cover 7, the edge portion 2*c* of the opening 2*b* is fitted into a recess 7*b* of a rectangular shape formed in an inner surface of the cover 7. However, in the case where the opening 2*b* was inwardly deformed (or tilted) because of molding shrinkage or others, the cover 7 could not be closed.

Furthermore, the terminal for being received in the terminal receiving chamber 2*a* of the connector housing 2 includes an electrical contact portion for electrical connection to the mating terminal, and a press-clamping portion (or crimping portion) press-fastened to a wire, the electrical contact portion and the press-clamping portion being disposed on a straight line. Therefore, when the wire of a relatively large diameter was press-clamped to the generally-straight terminal, the wire extending outwardly from the connector housing 2 through the through hole 7*a* of the cover 7 must be bent.

However, this operation for bending the large-diameter wire was difficult, and it was difficult to install the connector in a narrow space as in an engine room of a vehicle.

SUMMARY

This invention has been made in order to solve the above problems, and an object of the invention is to provide a connector in which at the time of closing an opening of a connector housing by a cover, inward deformation of those portions of the connector housing forming the opening can be corrected.

A connector according to the first aspect of the present invention is a connector which includes a connector housing including an upper wall, a bottom wall, and a side wall which define an opening having an U-shape when viewed from in a direction parallel to each of the upper wall, the bottom wall, and the side wall, wherein the opening opens in the direction; a terminal accommodated in the connector housing and including an end to which a wire is fastened, the end contacting both the upper wall and the bottom wall at the opening; and a cover which covers and uncovers the opening. Preferably, the connector of the first aspect includes a terminal including a electrical connection portion to which a mate terminal is electrically connected and a press-clamping portion to which a wire is fastened; a connector housing which accommodates the terminal and includes a top wall, a bottom wall, and a sidewall, wherein the top wall, the bottom wall, and the side wall define an opening which has a U-shape cross section and is formed at a side of the housing where the press-clamping portion is positioned, and the terminal contacts with the top wall and the bottom wall; and a cover which covers and uncovers the opening.

The second aspect of the present invention is a connector according to the first aspect of the invention, in which the terminal has a plane L-shape and the connector housing has a plane L-shape.

The third aspect of the present invention is a connector according to the first aspect of the invention, in which the end has a first press-clamping piece and a second press-clamping piece. The wire is fastened by the first and the second press-clamping so that the first press-clamping piece laps the second press-clamping piece. Instead, it is possible that the wire is fastened by the first and the second press-clamping so that the first and the second press-clamping pieces break into the wire.

According to the first aspect of the invention, the opening of the generally recumbent U-shaped cross-section is defined by the upper wall, the bottom wall and the side wall of the connector housing, and when the end of the terminal is to be received in the connector housing adjacent to the opening of the generally recumbent U-shaped cross-section, the end of the terminal is brought into contact with the upper and bottom walls of the connector housing defining the opening. With this construction, when inserting the terminal into the connector housing through the opening, inward deformation of the portions of the upper and bottom walls of the connector housing forming the opening can be easily and positively corrected, utilizing the press-clamping portion of the terminal.

According to the second aspect of the invention, the terminal has the L-shape in the plan view, and the electrical contact portion is formed at the one end of the L-shaped terminal, and the press-clamping portion is formed at the other end of the terminal. The connector housing has the L-shape in the plan view, and the L-shaped terminal is received in the L-shaped connector housing in such a manner that the press-clamping portion is located adjacent to the opening of the generally recumbent U-shaped cross-section. With this construction, even when a thick wire for supplying a large current is used, this wire does not need to be bent generally at right angles, and the connector can be easily installed in a narrow space in a vehicle or others, and the narrow space can be efficiently utilized.

According to the third aspect of the invention, the press-clamping portion of the terminal includes the first and the second press-clamping pieces press-fastened to the insulating sheath of the wire. The pair of press-clamping piece can be press-fastened to the insulating sheath of the wire in the overlapping form in which the two press-clamping piece overlap each other or in the B-clamp form in which the two press-clamping piece bite into the insulating sheath of the wire. The press-fastening crimp height of each of the overlapping form and the B-clamp form is generally equal to the height of the side wall between the inner surfaces of the upper and bottom walls of the connector housing at the opening of the generally recumbent U-shaped cross-section. Therefore, when the terminal is to be received in the terminal receiving chamber through the opening of the connector housing, the inward deformation of the portions of the upper and bottom walls of the connector housing forming the opening can be easily and positively corrected, utilizing the pair of the press-clamping piece of the overlapping type or the B-clamp type press-clamping portion of the terminal. Therefore, the molding time required for manufacturing the synthetic resin-made connector accurately into predetermined dimensions indicated in design drawings so as to provide the accepted product (connector) can be greatly reduced.

DETAILED DESCRIPTION OF EXEMPLARY EMBODIMENT OF THE PRESENT INVENTION

One exemplary embodiment of the present invention will now be described with reference to the drawings.

Figure 1:
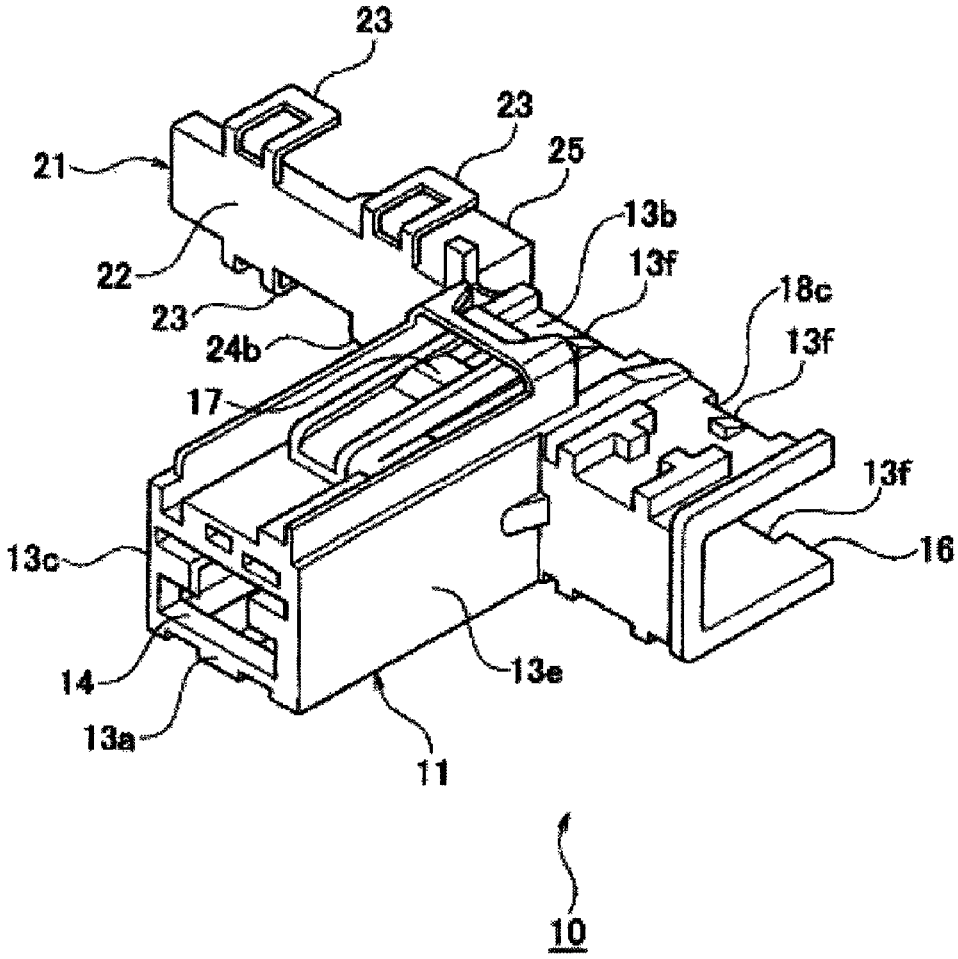
FIG. 1 is a perspective view of one exemplary embodiment of a connector of the present invention, showing an open condition of a cover.
Figure 2:
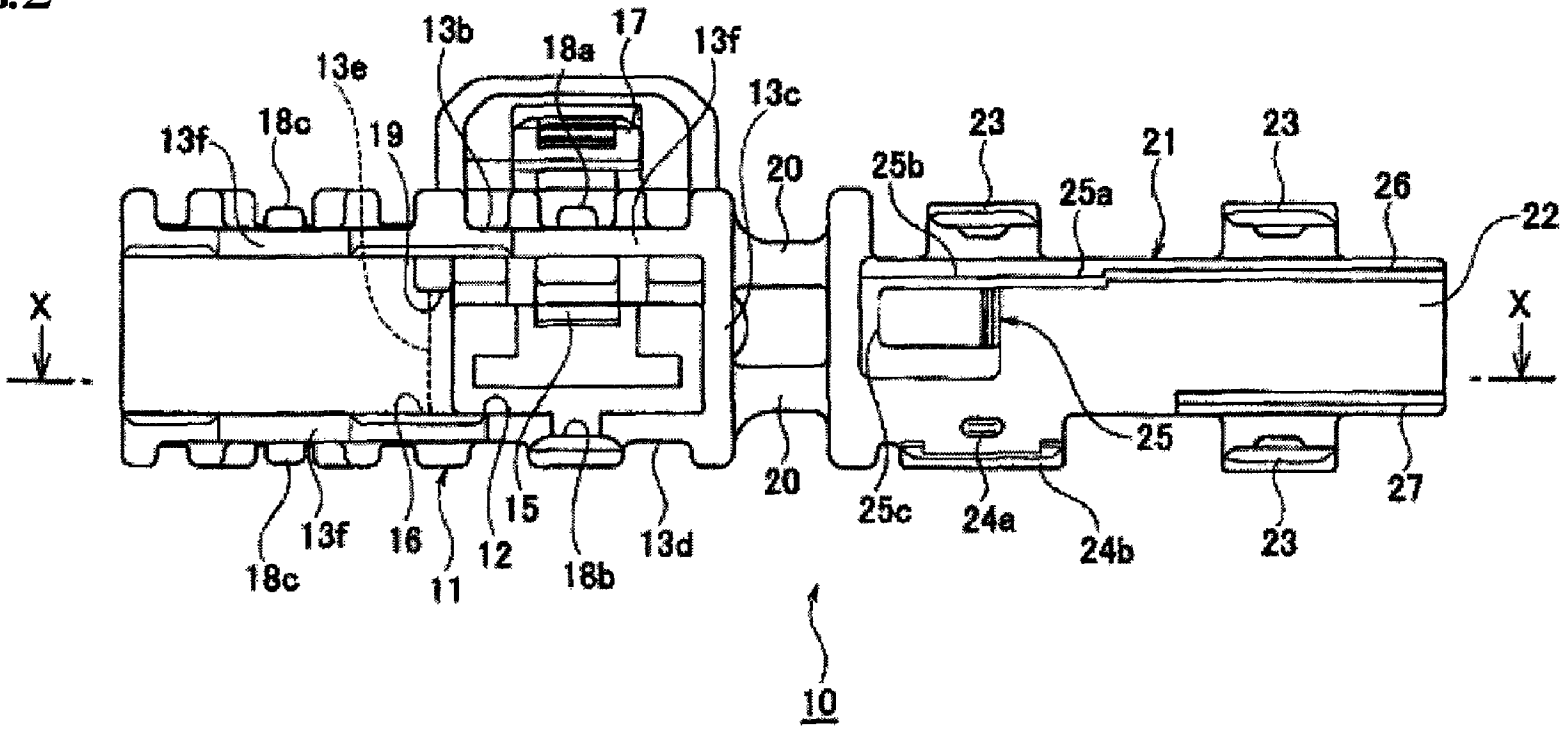
FIG. 2 is a rear view of the connector in the open condition of the cover.
Figure 3:
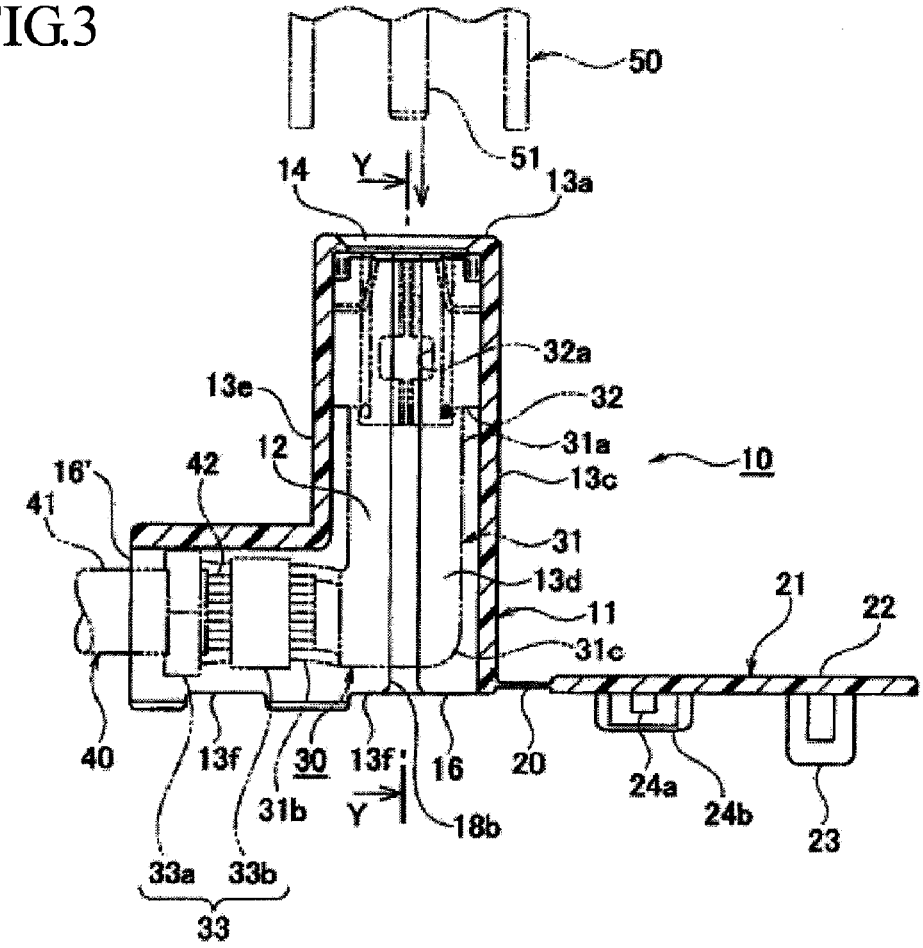
FIG. 3 is a cross-sectional view taken along the line X-X of FIG. 2.
Figure 4:
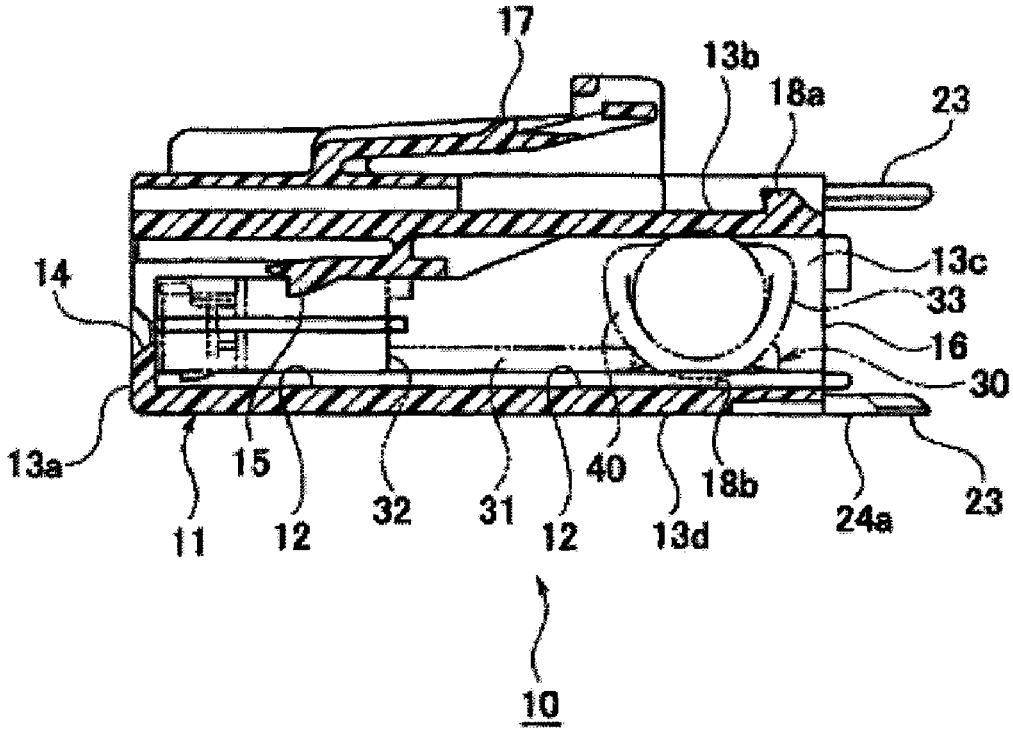
FIG. 4 is a cross-sectional view taken along the line Y-Y of FIG. 3.
Figure 5A:
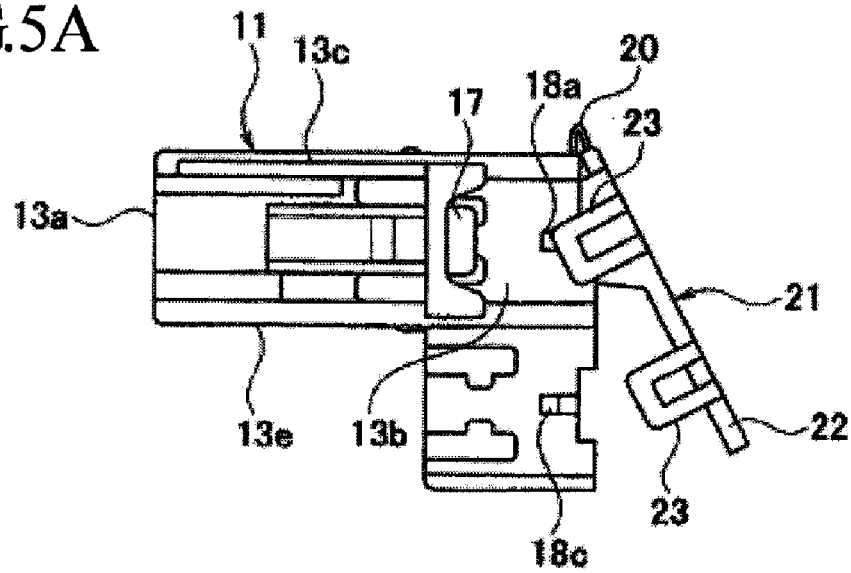
FIG. 5A is a plan view of the connector, showing a condition before the cover is closed.
Figure 5B:
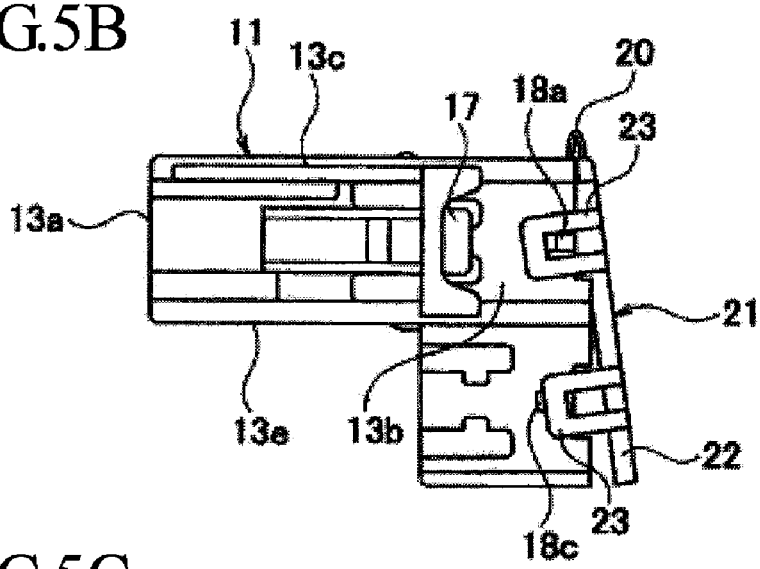
FIG. 5B is a view similar to FIG. 5A, but showing the process of closing the cover.
Figure 5C:
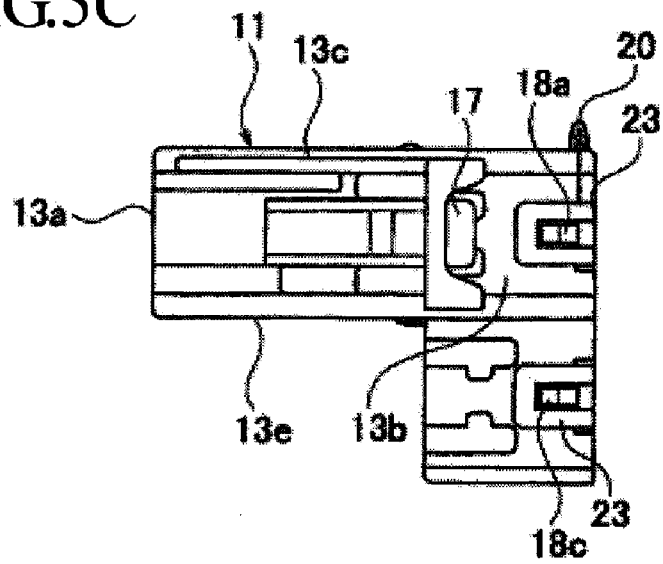
FIG. 5C is a view similar to FIG. 5A, but showing a closed condition of the cover.
Figure 6A:
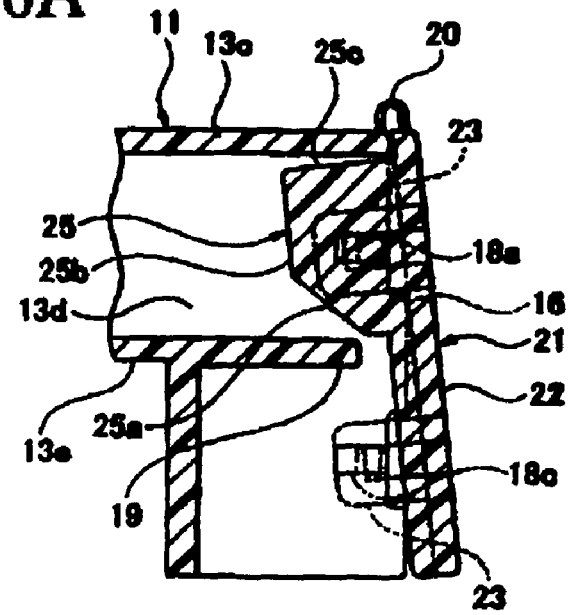
FIG. 6A is a cross-sectional view of an important portion of the connector, showing a condition before the cover is closed, with hinge portions (integrally molded with cover) flexibly bent at their central portions.
Figure 6B:
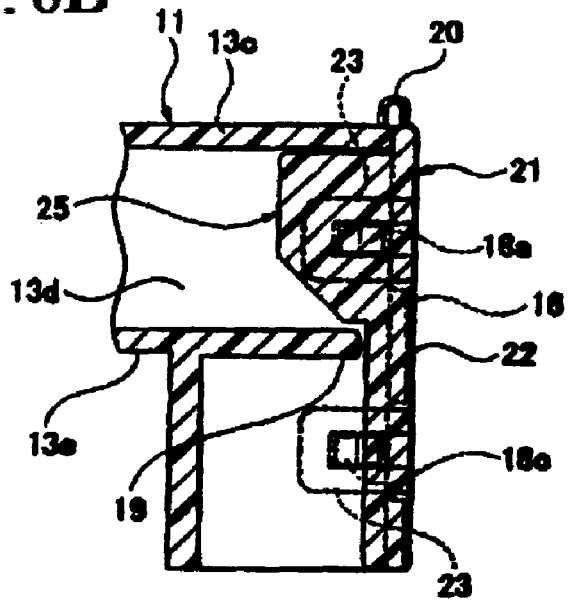
FIG. 6B is a view similar to FIG. 6A, but showing the closed condition of the cover.
Figure 7:
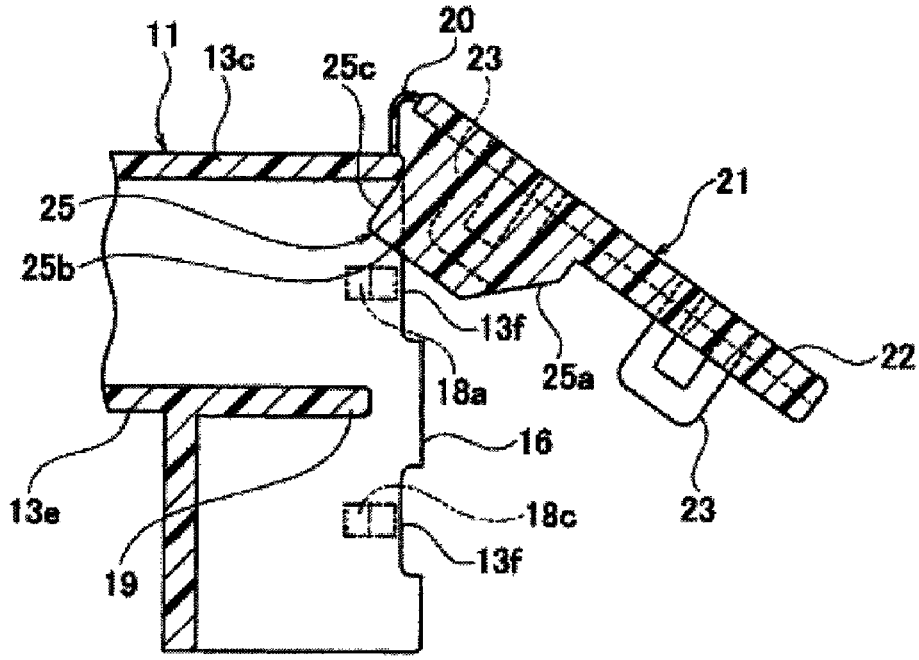
FIG. 7 is a cross-sectional view of the important portion, showing a condition before the cover is closed, with the hinge portions flexibly bent at their cover-side end portions.
Figure 8:
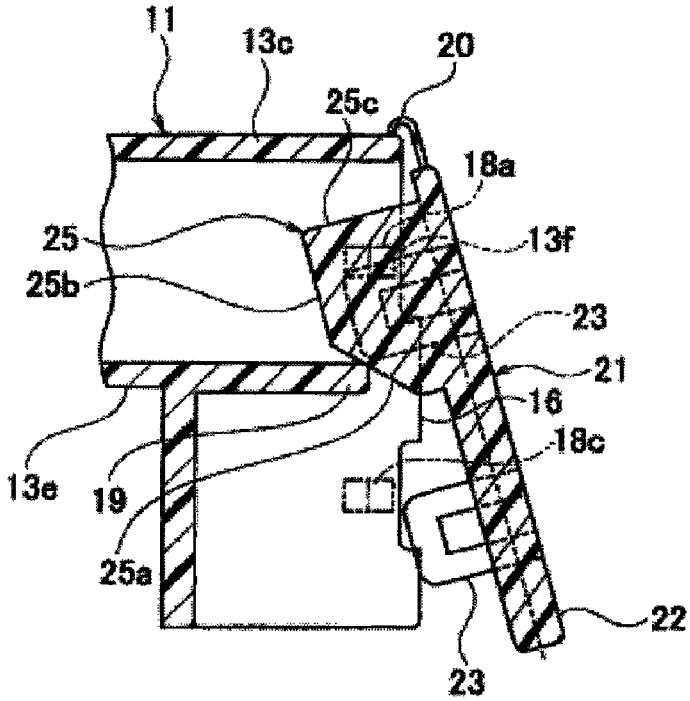
FIG. 8 is a cross-sectional view of the important portion, showing a condition before the cover is closed, with the hinge portions flexibly bent at their housing-side end portions.
Figure 9:
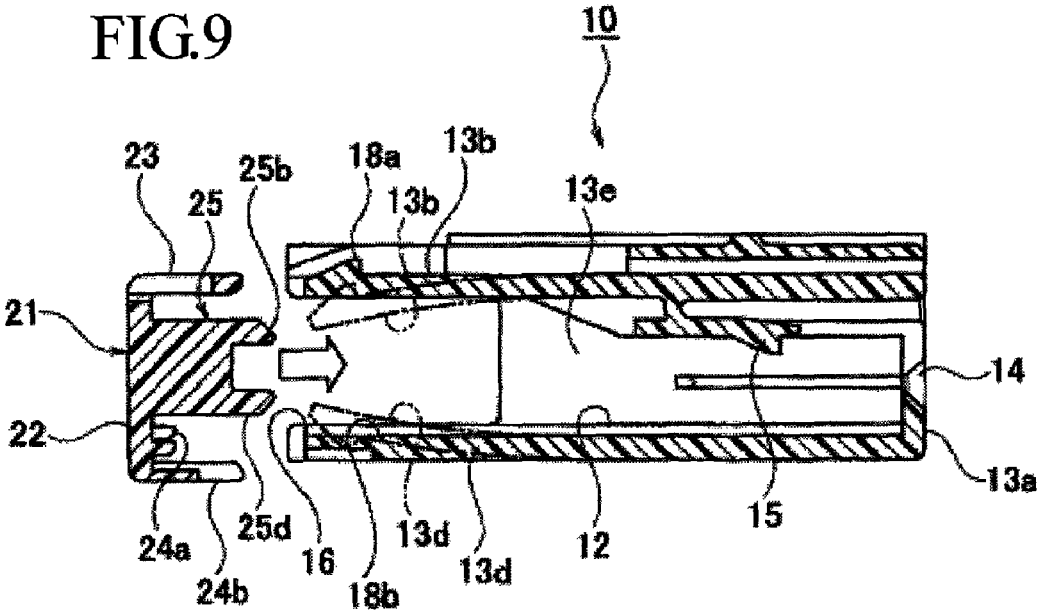
FIG. 9 is a cross-sectional view of the connector, showing a condition before the cover is closed.
Figure 10:
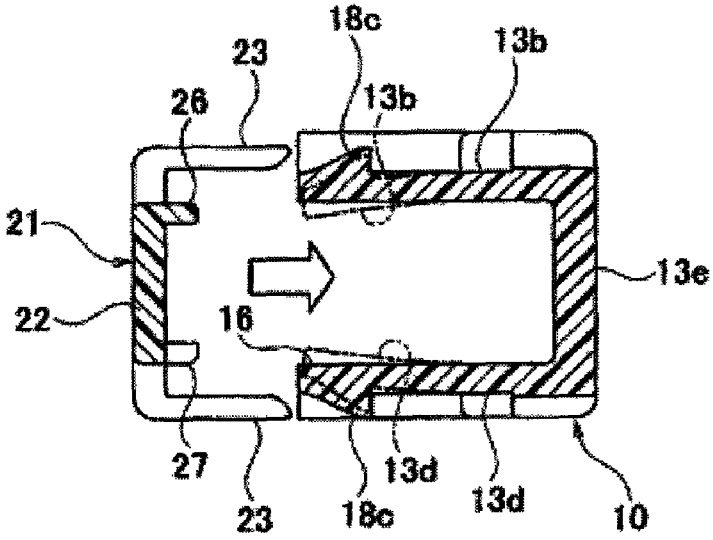
FIG. 10 is a cross-sectional view of an important portion of the connector, showing a condition before the cover is closed.
Figure 11:
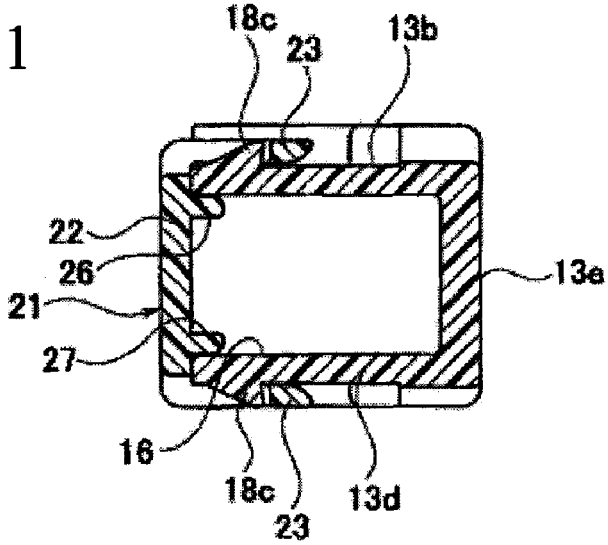
FIG. 11 is a view similar to FIG. 10, but showing the closed condition of the cover.
Figure 12:
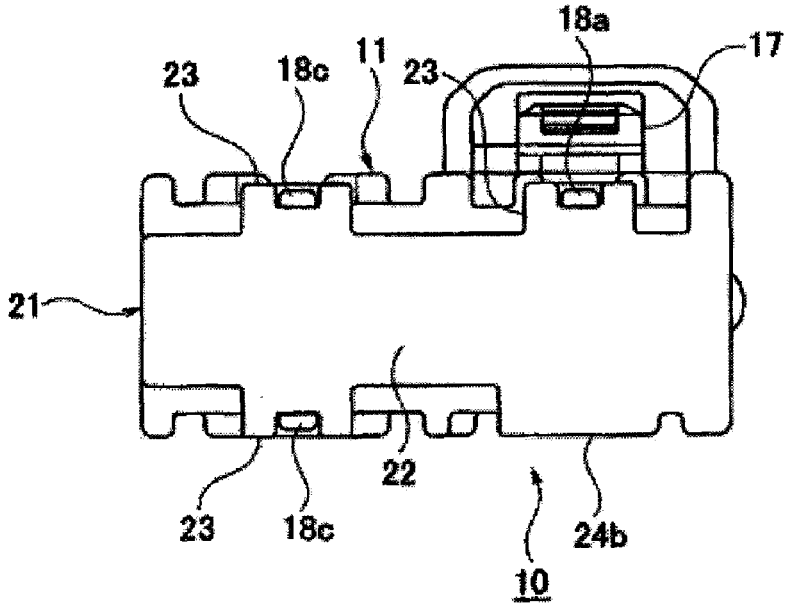
FIG. 12 is a rear view of the connector in the closed condition of the cover.
Figure 13A:
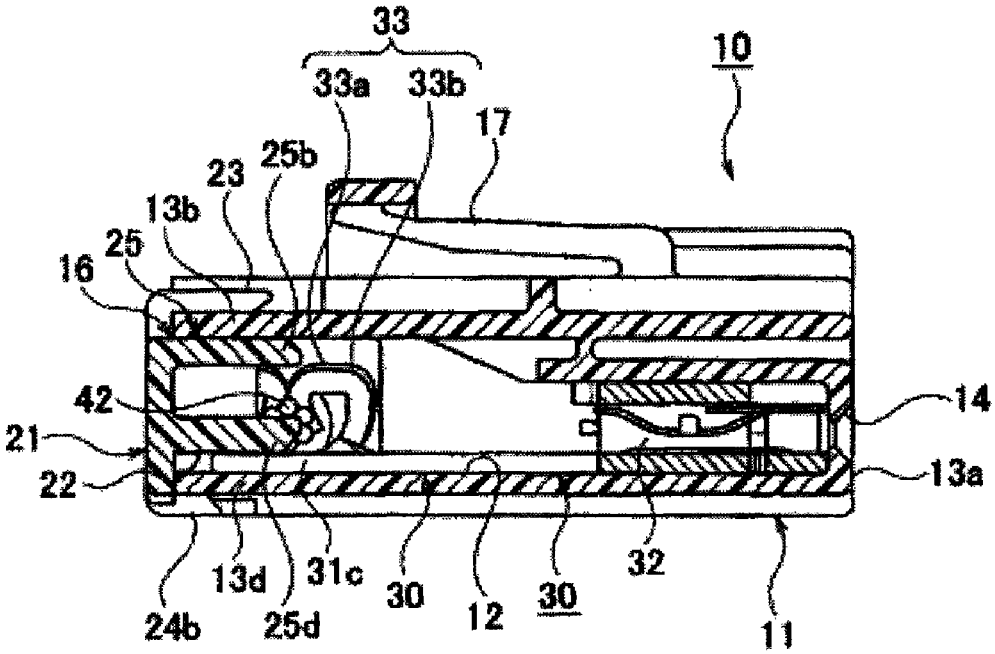
FIG. 13A is a cross-sectional view of the connector in the closed condition of the cover, showing the relation between the cover and a terminal.
Figure 13B:
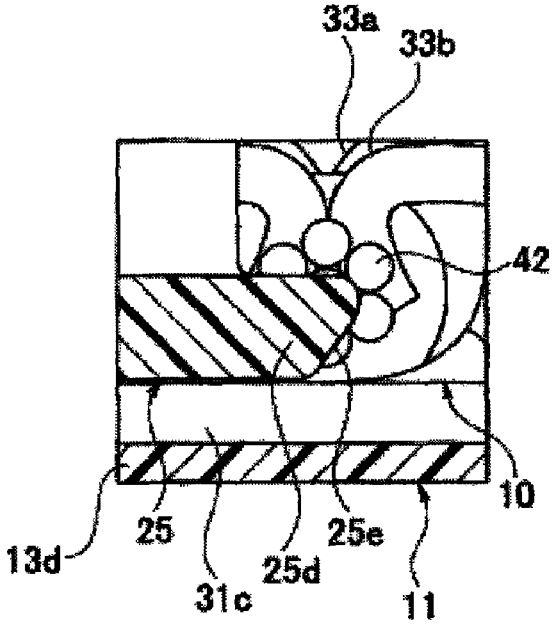
FIG. 13B is an enlarged cross-sectional view of an important portion of the connector in the closed condition of the cover.
Figure 14:
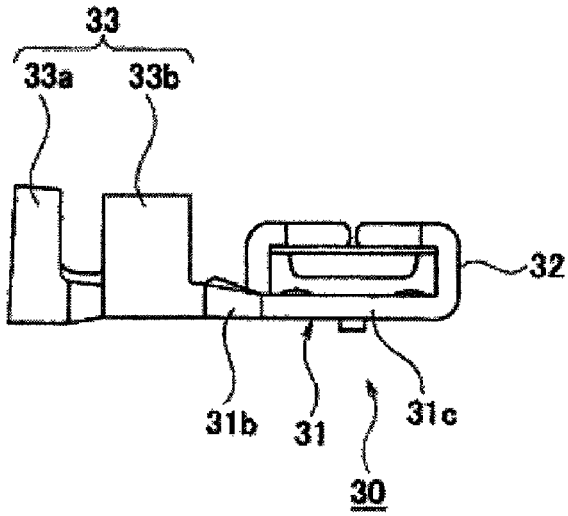
FIG. 14 is a rear view of the L-shaped terminal for being received in the connector.
Figure 15:
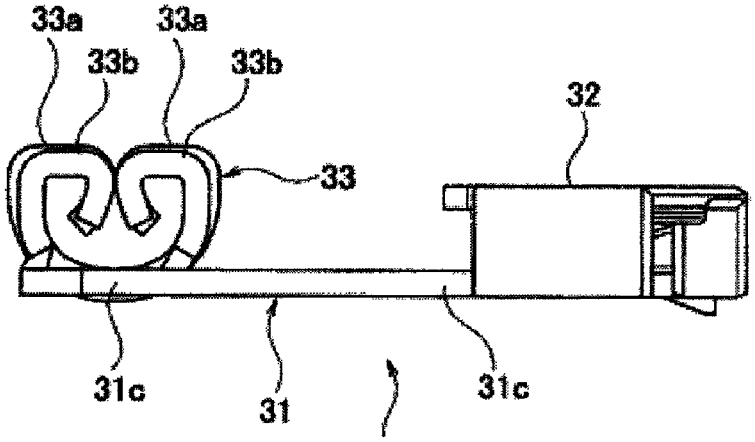
FIG. 15 is a side-elevational view of the L-shaped terminal.
Figure 16A:
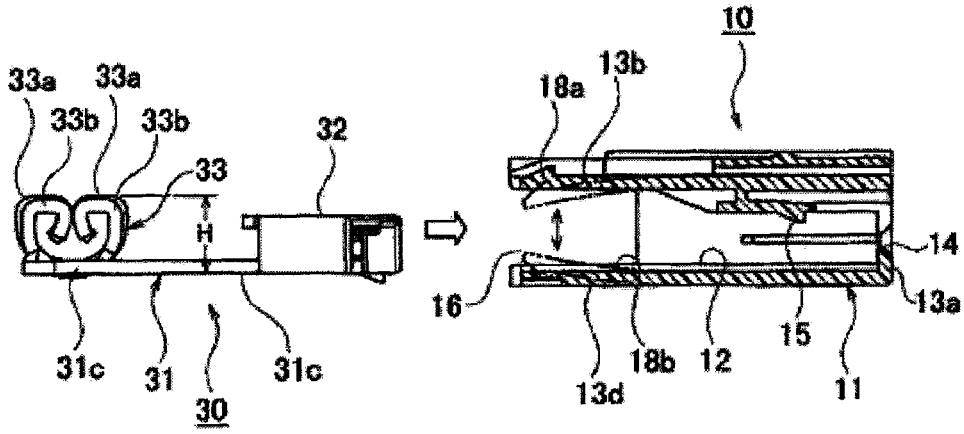
FIG. 16A is a cross-sectional view of the connector, showing a condition before the L-shaped terminal is received in the connector.
Figure 16B:
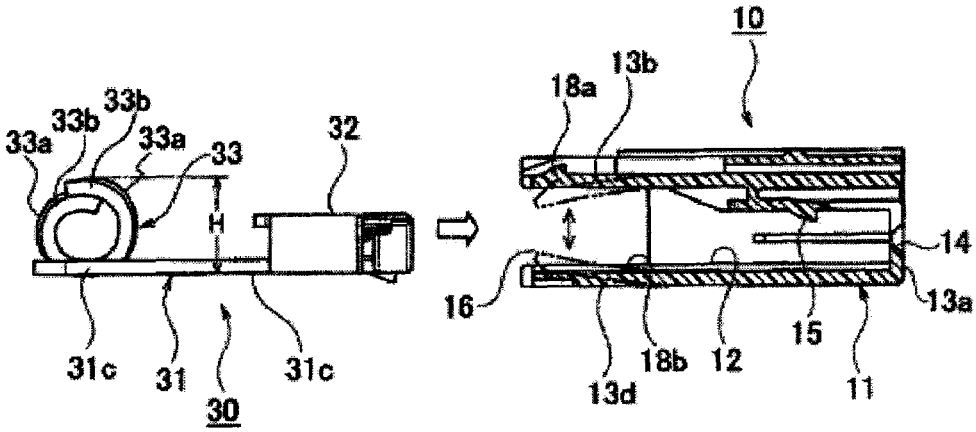
FIG. 16B is a cross-sectional view of the connector, showing a condition before another type of L-shaped terminal is received in the connector.
Figure 17:
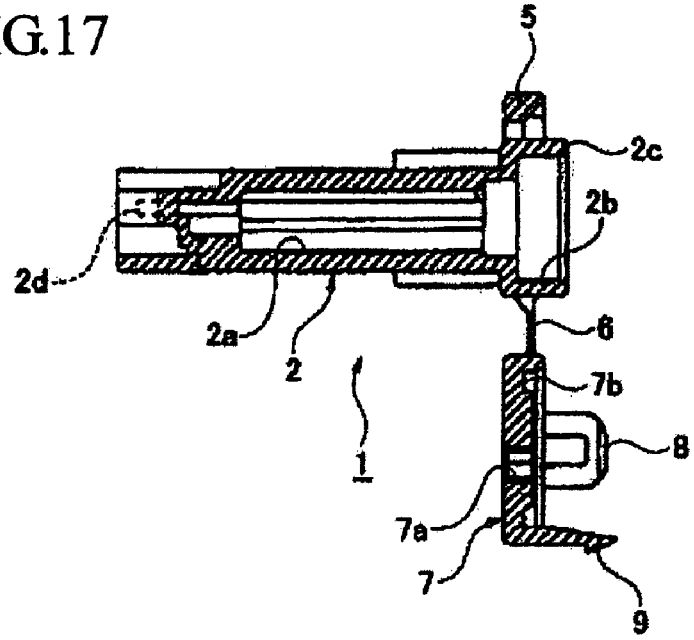
FIGS. 17 and 18 show a related connector.
Figure 18:
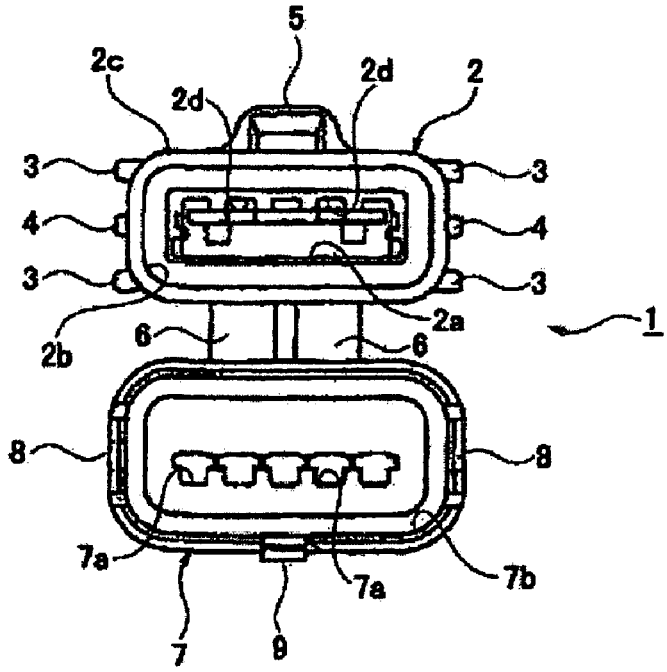

FIG. 1 is a perspective view of one exemplary embodiment of a connector of the invention, showing an open condition of a cover, FIG. 2 is a rear view of the connector in the open condition of the cover, FIG. 3 is a cross-sectional view taken along the line X-X of FIG. 2, FIG. 4 is a cross-sectional view taken along the line Y-Y of FIG. 3, FIG. 5A is a plan view of the connector, showing a condition before the cover is closed, FIG. 5B is a view similar to FIG. 5A, but showing the process of closing the cover, FIG. 5C is a view similar to FIG. 5A, but showing a closed condition of the cover, FIG. 6A is a cross-sectional view of an important portion of the connector, showing a condition before the cover is closed, with hinge portions (integrally molded with cover) flexibly bent at their central portions, FIG. 6B is a view similar to FIG. 6A, but showing the closed condition of the cover, FIG. 7 is a cross-sectional view of the important portion, showing a condition before the cover is closed, with the hinge portions flexibly bent at their cover-side end portions, FIG. 8 is a cross-sectional view of the important portion, showing a condition before the cover is closed, with the hinge portions flexibly bent at their housing-side end portions, FIG. 9 is a cross-sectional view of the connector, showing a condition before the cover is closed, FIG. 10 is a cross-sectional view of an important portion of the connector, showing a condition before the cover is closed, FIG. 11 is a view similar to FIG. 10, but showing the closed condition of the cover, FIG. 12 is a rear view of the connector in the closed condition of the cover, FIG. 13A is a cross-sectional view of the connector in the closed condition of the cover, showing the relation between the cover and a terminal, FIG. 13B is an enlarged cross-sectional view of an important portion of the connector in the closed condition of the cover, FIG. 14 is a rear view of the L-shaped terminal for being received in the connector, FIG. 15 is a side-elevational view of the L-shaped terminal, FIG. 16A is a cross-sectional view of the connector, showing a condition before the L-shaped terminal is received in the connector, and FIG. 16B is a cross-sectional view of the connector, showing a condition before a modified L-shaped terminal is received in the connector.

As shown in FIGS. 1 to 5, the connector 10 includes the L-shaped terminal 30 having an electrical contact portion 32 for electrical connection to a mating terminal 51 of a mating connector 50 and a press-clamping portion (or crimping portion) 33 press-fastened to a wire 40, a synthetic resin-made connector housing 11 including a terminal receiving chamber 12 for receiving the electrical contact portion 32 and the press-clamping portion 33 of the terminal 30 and an opening 16 of a generally recumbent U-shaped (or channel-shaped)

cross-section (for receiving the press-clamping portion 33 of the terminal 30) defined by an upper wall 13*b*, a bottom wall 13*d* and a side wall 13*c* of the connector housing 11, and the synthetic resin-made cover 21 formed integrally with the connector housing 11 through the hinge portions 20 so as to open and close the opening 16. The opening 16 has U-shape cross section when viewed from a direction parallel to each of the upper wall 13*b*, the bottom wall 13*d*, and the side wall 13*c*. The opening 16 opens in the direction.

As shown in FIGS. 1, 3 and 5, the connector housing 11 which is made of a synthetic resin has a box-like shape and an L-shape in a plan view (that is, when viewed from the top). The terminal receiving chamber 12 having an L-shape in a plan view is formed within the connector housing 11. A through hole 14 through which the mating terminal 51 passes is formed through a front wall 13*a* of the connector housing 11. As shown in FIGS. 4, 9 and 10, a lance (elastic retaining portion) 15 for retaining the electrical contact portion 32 of the terminal 30 (described later) is formed integrally on and projects from an inner surface of the upper wall 13*b* of the connector housing 11. The rear side of the connector housing 11 is formed into the opening 16 of a generally recumbent U-shaped cross-section open to the rear end of the connector housing 11. Namely, this opening 16 of the generally recumbent U-shaped cross-section is formed or defined by the upper wall 13*b*, the bottom wall 13*d* and the side wall 13*c* of the connector housing 11.

When the L-shaped terminal 30 is inserted into the L-shaped terminal receiving chamber 12 of the connector housing 11 through the opening 16 of the generally recumbent U-shaped-cross-section and is received therein as shown in FIG. 3, the press-clamping portion 33 of the terminal 30 and a proximal end portion 31*c* of a terminal body portion 31 of the terminal 30 are located adjacent to the opening 16 of the generally recumbent U-shaped cross-section. When the press-clamping portion 33 of the terminal 30 is to be received in the terminal receiving chamber 12 disposed adjacent to the opening 16 of the generally recumbent U-shaped cross-section, the press-clamping portion 33 of the terminal 30 is brought into contact with the upper and bottom walls 13*b* and 13*d* of the connector housing 11 forming the opening 16, as shown in FIG. 16.

As shown in FIGS. 1, 2 and 4, a lock arm 17 for releasably retaining the mating connector 50 is formed integrally on and projects from a generally longitudinally-central portion of the upper wall 13*b* of the connector housing 11. A retaining claw (retaining portion) 18*a* having a hook-like distal end is formed on and projects from the upper wall 13*b* of the connector housing 11 forming the opening 16, and is opposed to the lock arm 17. A groove-like recess 18*b* is formed in the bottom wall 13*d* of the connector housing 11 forming the opening 15, and is opposed to the retaining claw 18*a*. Retaining claws (retaining portions) 18*c* and 18*c* each having a hook-like distal end are formed integrally on and project respectively from those portions of the upper and bottom walls 13*b* and 13*d* of the connector housing 11 forming the opening 16, and are opposed to the press-clamping portion 33 of the terminal 30. A guide reception rib 19 is formed integrally on and projects from a central portion (opposed to the other side wall 13*e* of the connector housing 11) of an inner surface of the upper wall 13*b* of the connector housing 11 forming the opening 16. The pair of upper and lower hinge portions 20 and 20 are formed integrally on and extend between a rear end edge of the side wall 13*c* of the connector housing 11 and one end edge of the cover 21.

As shown in FIGS. 1 to 3 and FIGS. 5 to 12, the cover 21 includes a generally rectangular plate-like cover body 22. Engagement portions 23 of a generally square frame-shape are formed respectively on upper and lower edges of the cover body 22 which are to be opposed respectively to the retaining claws 18*a* and 18*c* (of the connector housing 11) each having the hook-like distal end, the engagement portions 23 extending perpendicularly from the cover body 22. These engagement portions 23 and the retaining claws 18*a* and 18*c* jointly form lock members for locking or holding the cover 21 in its closed condition relative to the upper wall 13*b*, side wall 13*c* and bottom wall 13*d* of the connector housing 11 which form the opening 16 of the generally recumbent U-shaped cross-section. Further, a smaller-width projection 24*a* and a larger-width projection 24*b* are formed integrally on and project from an inner surface of that portion (lower portion) of the cover body 22 which is to be opposed to the recess 18*b* in the bottom wall 13*d* of the connector housing 11. The smaller-width projection 24*a* can be fitted in the recess 18*b*, and the larger-width projection 24*b* can be fitted on the outside of the recess portion 18*b*.

As shown in FIGS. 2 and 6 to 8, a guide projection 25 of a generally square tubular shape is formed integrally on and projects from the inner surface of the cover body 22 of the cover 21 disposed above the smaller-width projection 24*a*. When each hinge portion 20 is flexibly bent or deformed at its housing-side end portion (disposed near to the connector housing 11) or at its cover-side end portion (disposed near to the cover 21) other than its central portion, the guide projection 25 interferes with the guide reception rib 19 or the side wall 13*c* of the connector housing 11, thereby guiding the cover body 22 to its proper closing position relative to the opening 16. The guide projection 25 has an inclined wall 25*a*. More specifically, when each hinge portion 20 is flexibly bent or deformed at its housing-side end portion as shown in FIG. 8, the inclined wall 25*a* of the guide projection 25 (formed integrally on the inner surface of the cover body 22 of the cover 21) is brought into abutting engagement with the guide reception rib 19 formed on the inner surface of the upper wall 13*b* of the connector housing 11, thereby guiding the cover body 22 to its proper closing position relative to the opening 16. On the other hand, when each hinge portion 20 is flexibly bent or deformed at its cover-side end portion as shown in FIG. 7, an upstanding wall 25*c* of the guide projection 25 is brought into abutting engagement with the side wall 13*c* of the connector housing 11, thereby guiding the cover body 22 to its proper closing position relative to the opening 16.

As shown in FIGS. 9 and 13A, an upper wall 25*b* of the guide projection 25 formed integrally on and projecting from the cover body 22 of the cover 21 serves as a correction portion for correcting inward deformation of the upper wall 13*b* of the connector housing 11 at the opening 16 side opening at the time of closing the opening 16 by the cover 21. Also, a bottom wall 25*d* of the guide projection 25 serves as a holding portion which cooperates with opening the bottom wall 13*d* of the connector housing 11 to hold the terminal body 31 of the terminal 30 therebetween at the opening 16 side when the cover 21 closes the opening 16. Further, the upstanding wall 25*c* of the guide projection 25 serves as a support portion for transmitting reaction forces from the terminal 30 and the bottom wall 13*d* of the connector housing 11 to the upper wall 13*b* between the upper wall 25*b* and the bottom wall 25*d*. Namely, the upstanding wall 25*c* of the guide projection 25 serving as the support portion enhances the function of holding the terminal body 31 of the terminal 30 between the bottom wall 25*c* of the guide projection 25 and the bottom wall 13*d* of the connector housing 11. Further, a slanting surface 25*e* is formed at a distal end of the bottom wall 25*d* of the guide projection 25 as shown in FIG. 13B.

Thanks to the provision of this slanting surface 25*e*, the cover 21 can be smoothly moved into the closing position without abutting against the proximal end portion 31*c* of the terminal body 31 at the time of closing the opening 16 by the cover 21.

As shown in FIGS. 2, 10 and 11, a pair of inward-tilting correction ribs 26 and 27 are formed integrally on and project respectively from the upper and lower edge portions of that end portion (or half portion) (which is to be opposed to the press-clamping portion 33 of the terminal 30 received in the opening 16) of the cover body 22 of the cover 21 remote from the guide projection 25.

As shown in FIGS. 3 and 13 to 16, the terminal body 31 of the terminal 30 has an L-shape in a plan view. The electrical contact portion 32 of a box-shape for connection to the mating terminal 51 is formed at one end 31*a* of the L-shaped terminal body 31 by bending relevant portions of the terminal 30. The press-clamping portion (or crimping portion) 33 for being press-fastened to the wire 40 is formed at the other end 31*b* of the terminal body 31 by bending relevant portions of the terminal 30.

A rectangular engagement hole 32*a* in which the lance 15 can be retainingly engaged is formed in a central portion of an upper surface of the box-shaped electrical contact portion 32 of the terminal 30. The press-clamping portion 33 of the terminal 30 includes a pair of press-clamping pieces 33*a* and 33*a* for being press-fastened to an insulating sheath 41 of the wire 40, and a pair of press-clamping piece 33*b* and 33*b* for being press-fastened to a conductor 42 of the wire 40. The pair of press-clamping pieces 33*a* and 33*a* can be press-fastened to the insulating sheath 41 of the wire 40 in an overlapping form in which the two press-clamping pieces 33*a* and 33*a* overlap each other or in a B-clamp form in which the two press-clamping pieces 33*a* and 33*a* bite into the insulating sheath 41 of the wire 40. A press-fastening crimp height (H) of each of the overlapping form and the B-clamp form is generally equal to a height of the side wall 13*c* between the inner surfaces of the upper and bottom walls 13*b* and 13*d* of the connector housing 11 at the opening 16 of the generally recumbent U-shaped cross-section.

As shown in FIGS. 1 and 3, a pair of notches 13*f* are formed respectively in those portions of rear ends (end portions at which the opening 16 is formed) of the upper and bottom walls 13*b* and 13*d* of the connector housing 11 which are to be opposed respectively to the engagement portions 23 of the generally square frame-shape and the larger-width projection 24*b* of the cover 21. As shown in FIG. 3, the wire 40 is led out of the connector housing 11 through an opening 16' of a generally recumbent U-shaped cross-section formed by the other side wall 13*e*, the upper wall 13*d* and the bottom wall 13*d* of the connector housing 11.

In the connector 10 of the above embodiment, the L-shaped (in the plan view) terminal body 31 of the terminal 30 is received in the L-shaped (in the plan view) terminal receiving chamber 12 of the connector housing 11 in such a manner that the press-clamping portion 33 is located adjacent to the opening 16 of the generally recumbent U-shaped cross-section as shown in FIG. 3. Therefore, even when the thick wire 40 for supplying a large current is used, this wire 40 does not need to be bent generally at right angles in contrast with the case where a straight terminal of an ordinary type is used. Therefore, the connector can be easily installed, for example, in a narrow space within an engine room, and the space within the engine room can be utilized efficiently.

Furthermore, the opening 16 of the connector housing 11 having the generally recumbent U-shaped cross-section is defined by the upper wall 13*b*, the bottom wall 13*d* and the side wall 13*c* of the connector housing 11, and when the press-clamping portion 33 of the terminal 30 is to be received in the terminal receiving chamber 12 disposed adjacent to the opening 16 of the generally recumbent U-shaped cross-section, the press-clamping portion 33 is brought into contact with those portions of the upper and bottom walls 13*b* and 13*d* of the connector housing 11 forming the opening 16. With this construction, at the time of inserting the terminal 30 into the terminal receiving chamber 12 through the opening 16 of the connector housing 11, the press-clamping portion 33 of the terminal 30 is forced between the portions of the upper and bottom walls 13*b* and 13*d* of the connector housing forming the opening 16, and therefore the inward deformation (inward tilting) of the upper and bottom walls 13*b* and 13*d* can be corrected, utilizing curved portions of the press-clamping portion 33 of the terminal 30, so that the upper and bottom walls 13*b* and 13*d* can be forced away from each other into their respective proper positions.

Furthermore, the press-clamping portion 33 of the terminal 30 includes the pair of press-clamping pieces 33*a* and 33*a* press-fastened to the insulating sheath 41 of the wire 40. The pair of press-clamping pieces 33*a* and 33*a* can be press-fastened to the insulating sheath 41 of the wire 40 in the overlapping form in which the one press-clamping piece 33*a* laps the other press-clamping piece 33*a* overlap each other or in the B-clamp form in which the two press-clamping pieces 33*a* and 33*a* break into the insulating sheath 41 of the wire 40. The press-fastening crimp height (H) of each of the overlapping form and the B-clamp form is generally equal to the height of the side wall 13*c* between the inner surfaces of the upper and bottom walls 13*b* and 13*d* of the connector housing 11 at the opening 16 of the generally recumbent U-shaped cross-section. Therefore, when the terminal 30 is to be received in the terminal receiving chamber 12 through the opening 16 of the connector housing 11 as shown in FIGS. 16A and 16B, the press-clamping pieces 33*a* and 33*a* of the overlapping type or the B-clamp type press-clamping portion 33 of the terminal 30 are forced between the portions of the upper and bottom walls 13*b* and 13*d* of the connector housing forming the opening 16, and therefore the inward deformation (inward tilting) of the upper and bottom walls 13*b* and 13*d* can be corrected, utilizing curved (or radiused) portions of the press-clamping portion 33 of the terminal 30, so that the upper and bottom walls 13*b* and 13*d* can be forced away from each other into their respective proper positions.

When the connector housing 11 is molded of a resin, the portions of the upper and bottom walls 13*b* and 13*d* of the connector housing 11 forming the opening 16 are liable to be inwardly deformed (tilted). However, the press-fastening crimping height H of the B-clamp type or the overlapping type clamping portion 33 of the terminal 30 is set to the optimum dimension, and by doing so, the above inward deformation can be easily and positively corrected, utilizing the pair of press-clamping pieces 33*a* and 33*a* of the press-clamping portion 33 of the terminal 30. Therefore, the molding time required for manufacturing the plastics material-made connector 10 accurately into predetermined dimensions indicated in design drawings so as to provide the accepted product (connector) can be greatly reduced.

In the above embodiment, although the invention is directed to the connector for use with the thick wire for supplying a large current, the invention can be applied to a connector for use with a thin wire for supplying a small current.

The invention claimed is:

1. A connector comprising:

a connector housing including an upper wall comprising an interior upper wall surface and an exterior upper wall surface, a bottom wall comprising an interior bottom wall surface and an exterior bottom wall surface, and a side wall comprising an interior side wall surface and an exterior side wall surface, which define an opening having an U-shape when viewed from a direction parallel to each of the upper wall, the bottom wall, and the side wall, wherein the opening opens in the direction;

a terminal accommodated in the connector housing and including a press-clamping end to which a wire is fastened, the press-clamping end contacting both the interior upper wall surface and the interior bottom wall surface at the opening; and a cover which covers and uncovers the opening, the cover comprising an upper projection having a slanted surface configured to contact the interior upper wall surface when the upper projection is inserted into the connector housing, in a state where the upper wall is deformed inward; and a lower projection having a slanted surface configured to contact the interior bottom wall surface when the lower projection is inserted into the connector housing, in a state where the bottom wall is deformed inward;

wherein the exterior upper wall surface, the exterior bottom wall surface, and the exterior side wall exterior define an exterior of the connector housing.

2. The connector according to claim 1, wherein the terminal has a plane L-shape and the connector housing has a plane L-shape.

3. The connector according to claim 1, wherein the end has a first press-clamping piece and a second press-clamping piece, wherein the wire is fastened by the first and the second press-clamping so that the first press-clamping piece laps the second press-clamping piece.

4. The connector according to claim 1, wherein the end has a first press-clamping piece and a second press-clamping piece, wherein the wire is fastened by the first and the second press-clamping so that the first and the second press-clamping pieces break into the wire.

5. The connector according to claim 1, wherein the cover is integrally formed with the connector housing through a hinge portion.

6. A connector comprising:

a terminal including a electrical connection portion to which a mate terminal is electrically connected and a press-clamping portion to which a wire is fastened;

a connector housing which accommodates the terminal and includes an upper wall comprising an interior upper wall surface and an exterior upper wall surface, a bottom wall comprising an interior bottom wall surface and an exterior bottom wall surface, and a side wall comprising an interior side wall surface and an exterior side wall surface;

wherein the upper wall, the bottom wall, and the side wall define an opening which has a U-shape cross section and is formed at a side of the housing where the press-clamping portion is positioned, the press-clamping portion of the terminal contacts with the interior upper wall surface and the interior bottom wall surface, and the exterior upper wall surface, the exterior bottom wall surface, and the exterior side wall surface define an exterior of the connector housing; and a cover which covers and uncovers the opening, the cover comprising an upper projection having a slanted surface configured to contact the interior upper wall surface when the upper projection is inserted into the connector housing, in a state where the upper wall is deformed inward; and a lower projection having a slanted surface configured to contact the interior bottom wall surface when the lower projection is inserted into the connector housing, in a state where the bottom wall is deformed inward.

7. The connector according to claim 6, wherein the terminal has a plane L-shape and the housing has a plane L-shape.

8. The connector according to claim 6, wherein the press-clamping portion has a first press-clamping piece and a second press-clamping piece, wherein the wire is fastened by the first and the second press-clamping so that the first press-clamping piece laps the second press-clamping piece.

9. The connector according to claim 6, wherein the press-clamping portion has a first press-clamping piece and a second press-clamping piece, wherein the wire is fastened by the first and the second press-clamping so that the first and the second press-clamping pieces break into the wire.

10. The connector according to claim 6, wherein the cover is integrally formed with the connector housing through a hinge portion.

* * * * *